United States Patent [19]

Musel

[11] 4,444,326

[45] Apr. 24, 1984

[54] CHILD-RESISTANT CONTAINER CLOSURE

[75] Inventor: Robert J. Musel, Northfield, N.J.

[73] Assignee: Wheaton Industries, Millville, N.J.

[21] Appl. No.: 503,877

[22] Filed: Jun. 13, 1983

[51] Int. Cl.[3] ..... B65D 55/02

[52] U.S. Cl. ..... 215/209; 215/206; 215/211; 215/224

[58] Field of Search ..... 215/209, 224, 211, 206, 215/225; 206/1.5

[56] References Cited

U.S. PATENT DOCUMENTS 3,850,326 11/1974 Ryles ..... 215/224

4,042,105 8/1977 Taylor ..... 215/209

*Primary Examiner*—George T. Hall

*Attorney, Agent, or Firm*—Ratner & Prestia

[57] ABSTRACT

Child-resistant closure comprises a closure neck with an opening surrounded by an inner and an outer wall and a closure cap with a skirt matingly engaged by the inner wall and extending to the outer wall, the outer wall including a deformable segment to permit inward finger deformation and upward pressure on the underside of the lip of the closure cap, with improvements comprising reinforcement means in the closure cap and/or closure neck to prevent radial deformation of the closure in the area of the opening, other than at the preselected outer wall deformable segment location. Preferably, the reinforcement means comprises radially disposed ribs associated with the closure cap and also radially disposed ribs extending between the inner and outer walls of the closure neck surrounding the opening thereof. Preferably also the closure includes an upwardly extending rim on the outer wall of the closure neck substantially surrounding the closure cap lip so as to preclude inadvertent or accidental upward movement of the closure due to frictional engagement of the exposed edge of the lip and to transmit inward radial force on the outer wall to the cap lip rather than to other portions of the closure cap.

12 Claims, 9 Drawing Figures

CHILD-RESISTANT CONTAINER CLOSURE

BACKGROUND OF THE INVENTION

This invention pertains to an improved child-resistant container closure and to the elements thereof.

In particular, this invention pertains to such a closure useful with a storage receptacle for medicines, such as those in pill, tablet or capsule form, and other chemical substances potentially harmful to children, which closure is readily openable by an adult, but which may be opened either inadvertently or otherwise only with great difficulty by a child.

Among such closures previously proposed, that disclosed in U.S. Pat. No. 3,850,326 Ryles is considered pertinent as a background teaching with respect to the present invention.

The closure disclosed in the Ryles patent includes a cap or closure member with a lip overlying the rim surrounding an opening in the container. At one location on that rim, a slot 12 (as best seen in FIGS. 3 and 11) is provided so that the outer periphery of the rim may be deformed inwardly by finger pressure, thus rendering the underside of the overlying lip of the cap accessible for upward opening pressure on the cap member. The disclosure of the above-referenced Ryles patent suggests that in the absence of directional indicia, the significance of which would be perceived only by an adult, a person, particularly a child, would not be led to perform the necessary finger actuation of inwardly deforming the rim at the point of slot 12 and then upwardly actuating the overlying lip of the cap to remove the cap from the container opening.

Applicant's assignee, as a licensee under the above-identified Ryles patent, has tested containers with closures of the type disclosed there. Through such testing and related experience, Applicant has determined that a closure of the type disclosed in the Ryles patent is not as resistant, to opening by a child, as may be required, even though it is superior in many respects to other prior closure designs intended to be child-resistant. A more child-resistant closure is, therefore, highly desirable and indeed is required in the U.S., in order to comply with the U.S. Poison Prevention and Packaging Act of 1970.

Accordingly, it is the general object of the present invention to provide a child-resistant closure improved with respect to possible opening of the container by a child.

In particular, it is an object of this invention to provide a closure openable generally in the manner disclosed in the above-referenced Ryles patent, but improved with respect to possible opening by a child, so that it complies with the U.S. Poison Prevention and Packaging Act of 1970.

BRIEF DESCRIPTION OF THE INVENTION

Briefly, these objects are met by a closure of the general type disclosed in the Ryles patent, but improved by the provision of reinforcement means and/or a protective rim associated with an outer wall, which, together with a spaced inner wall, surround a closure neck opening. The closure includes a cap with a cap lip overlying the inner wall and the space between the inner wall and the outer wall of the closure neck and the outer wall includes an inwardly deformable segment and a discontinuity in the protective rim at a preselected circumferential location.

Preferably, the reinforcement means comprises ribs associated with the closure cap and distributed radially from the center of the cap to the dependent skirt of the cap which matingly engages the inner wall of the closure neck opening, and also reinforcing ribs radially disposed at locations other than that at which the deformable segment of the neck outer wall is disposed, between the inner and outer walls of the neck.

Preferably also, the neck outer wall rim substantially surrounds the outer edge of the cap lip, so as to minimize the possibility of inadvertent upward movement of the cap, either by frictional engagement at the edges thereof, or by a popping-up of the cap, due to inward pressure. The latter mode of failure may occur when inward pressure is applied to the closure neck, such as by a child biting it, the rim transmits such inward deforming force on the closure neck, other than at the deformable segment thereof to the closure cap lip, rather than to the cap body generally. For a better understanding of this invention, reference may be made to the detailed description thereof which follows, taken in conjunction with the accompanying figures and appended claims.

BRIEF DESCRIPTION OF THE FIGURES

In the figures:

FIG. 1 is a plan view of the preferred closure;

FIG. 2 is an elevation view of the preferred closure;

FIG. 3 is a detailed sectional view of the closure in the plane 3—3 as shown in FIG. 1;

FIG. 4 is a detailed cross-sectional view of the closure in the plane 4—4, as shown in FIG. 1;

FIG. 5 is a detailed sectional view of one edge of the closure, as shown in FIG. 4, with certain operational movements of the elements of the closure indicated;

FIG. 6 is a plan view of the closure with the cap portion thereof in the fully opened position;

FIG. 7 is a partial sectional view of the closure, taken in the plane 7—7 seen in FIG. 6, with the cap in the open position;

FIG. 8 is a detailed sectional view showing a modified form of cap reinforcement means; and FIG. 9 is a detailed sectional view of a closure otherwise similar to that shown in FIGS. 1–7, but in which the closure cap and closure neck are not attached to one another.

DETAILED DESCRIPTION OF THE INVENTION

Figure 1:
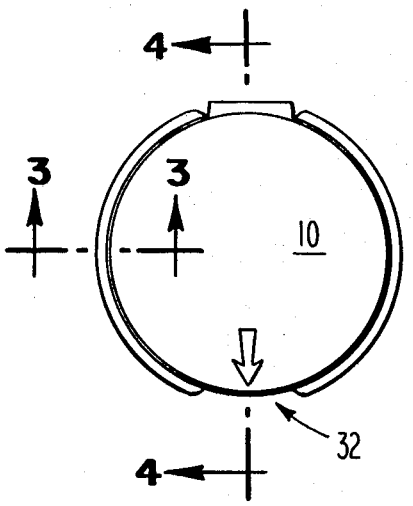
FIGS. 1–7 illustrate the closure of the present invention, in the preferred form thereof, in particular.
Figure 2:
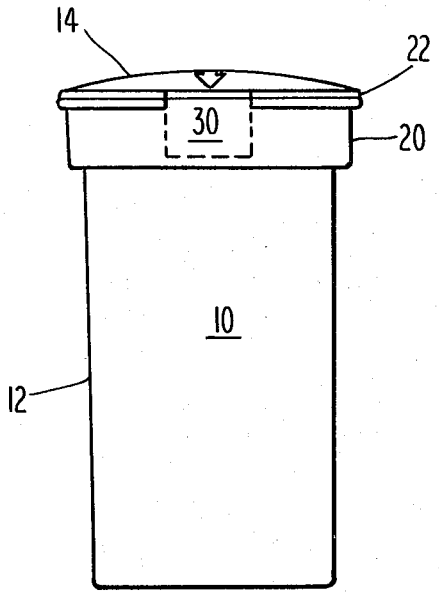
Figure 3:
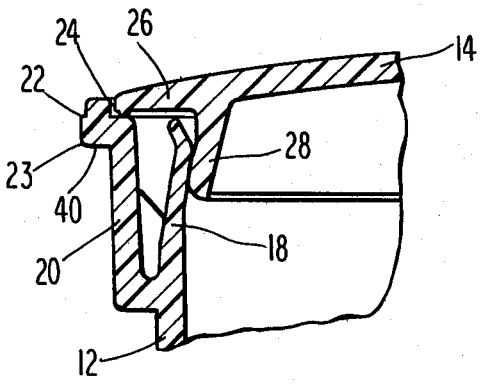

Referring to FIGS. 1–7, there is shown a container-closure combination 10, comprising a single integrally molded piece, including a container 12 and a closure cap 14, container 12 having a closure neck comprising an opening 16 surrounded by an inner wall 18 and an outer wall 20. An upwardly extending rim 22 of outer wall 20 substantially surrounds the outer edge 24 of a lip 26 of closure cap 14. Closure cap 14 also includes a dependent skirt 28, matingly engaged by inner wall 18.

The provision of an inwardly tapering surface at the upper end of inner wall 18 and a mating outwardly flaired section of dependent skirt 28, together with the inherent resiliency of typical materials of construction for a product like that of this invention (polypropylene, for example) provides effective sealing of opening 16 by closure 14. (The effectiveness of this seal is, of course, enhanced by a proper selection of the dimensions, angles, and radii of the mating sections of closure cap and closure neck, in accordance with known specifications and techniques.)

At a preselected circumferential location of outer wall 20, an inwardly deformable segment 30 of outer wall 20 is provided, along with a discontinuity 32 in rim 22 to facilitate inward deformation of segment 20 by finger pressure, to provide finger accessibility to the underside of lip 26 and thus to permit upward opening actuation of closure 14. This is best illustrated by the arrows showing the inward deformation of segment 30 and the resultant upward movement of lip 26 and closure cap 14, in FIG. 5.

The provision of an upwardly extending rim substantially surrounding the outer edge 24 of lip 26 of closure cap 14 effectively precludes accidental or inadvertent upward frictional engagement of closure 14 at the edge thereof and minimizes radial deformation (and possibly resultant popping-up) of closure cap 14 by inward pressure on outer wall 20.

As a further feature, the closure of this invention may also be rendered tamper-resistant, i.e., substantially unopenable prior to first use, by the provision of a removable segment, preferably a frangible segment, of rim 22, located in the area of discontinuity 32 and deformable outer wall segment 30, which removable or frangible segment of rim 22 also extends upwardly and surrounds the outer edge 24 of closure cap 14 at the preselected location of deformable outer wall segment 30. Upon first use, the removable or frangible segment would simply be removed, thus rendering the combination useful as previously described.

In accordance with the preferred embodiment of this invention, closure-container combination 10 is formed of a single integrally molded piece by the provision of a thin hingeable connecting member 34, by which closure 14 and outer wall 20 are attached to one another at a location diametrically opposite that of deformable wall segment 30 and discontinuity 32 in upwardly extending rim 22. Preferably also, member 34 is connected to outer wall 20 just below a second discontinuity 35 in rim 22 so that in the closed position (shown in FIG. 4), it functions essentially as part of rim 22.

In accordance with one aspect of the present invention, accidental or inadvertent opening of the container-closure combination of this invention is also avoided by the provision of reinforcement means in the closure cap and/or the closure neck of this invention, which means are adapted to further minimize radial deformation (i.e., deformation of the closure neck and/or cap toward or away from the center of the neck opening). In accordance with the preferred embodiment of this invention, this reinforcement means comprises, in the closure neck, a plurality of reinforcing ribs 36, radially disposed about opening 16 and extending between inner wall 18 and outer wall 20 at a plurality of radial locations other than that of deformable outer wall segment 30.

Alternately or in addition, radial deformation, and possible inadvertent opening of the closure of this invention, is provided by reinforcement means in the closure cap. In the preferred embodiment of the present invention, this reinforcement means comprises radially extending ribs 38 associated with closure cap 14.

Figure 4:
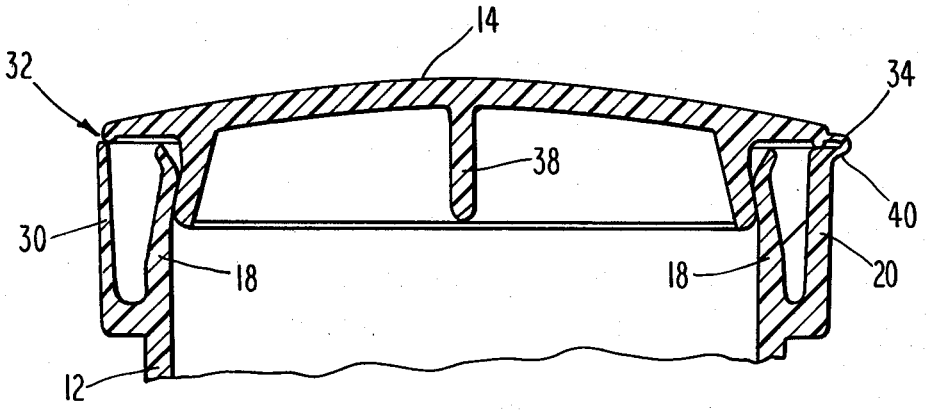
Figure 5:
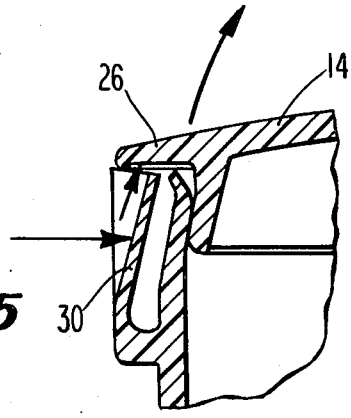
Figure 6:
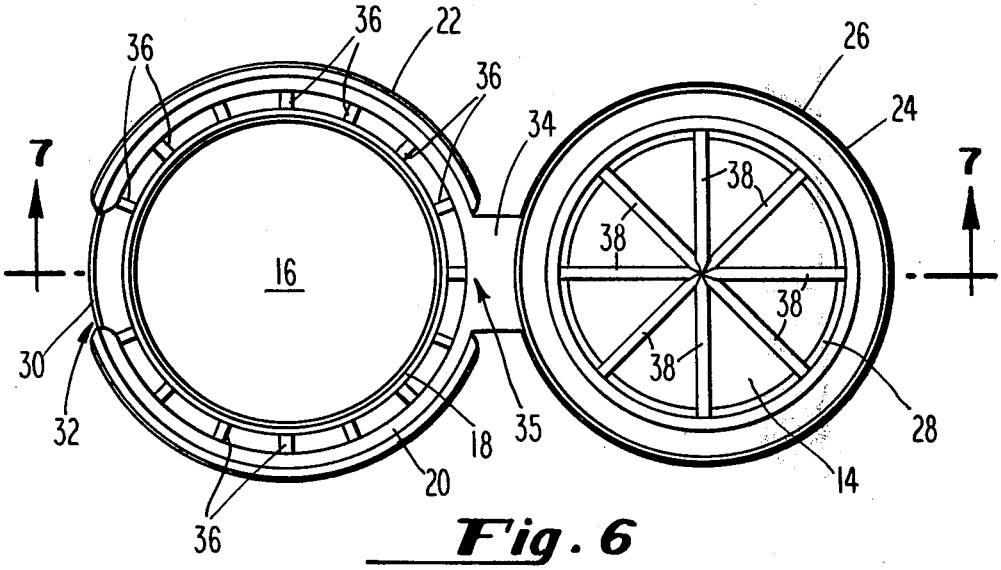
Figure 7:
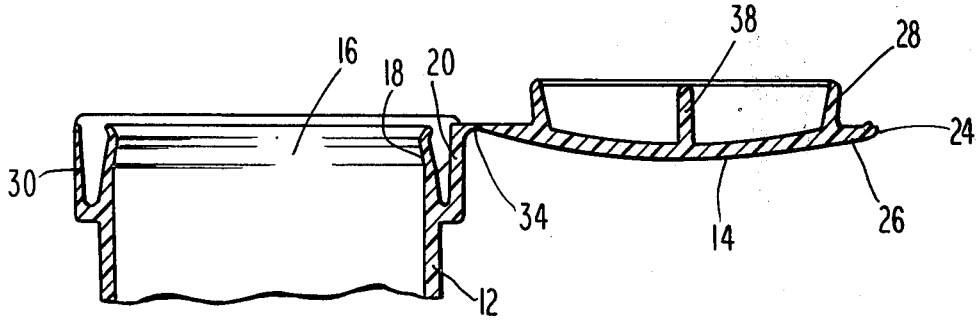

With container 12, including the closure neck thereof, and closure cap 14 in their mating closed position, as shown in FIG. 4, hingeable connecting member 34, along with an outward extention 23 (seen in FIG. 3), also provides a slight outwardly extending lip 40 which contributes to the child-resistance (to opening) of the closure of the present invention in its preferred embodiment, by providing, to the child, a seeming upward lever for opening of closure 14. In actual tests, children have tended to try to open closure 14 by repeatedly pressing upwardly on outwardly extending lip 40. To some degree, this may frustrate a child's effort to open the closure-container combination and thus contribute to the effectiveness of the child-resistance of this invention.

Figure 8:
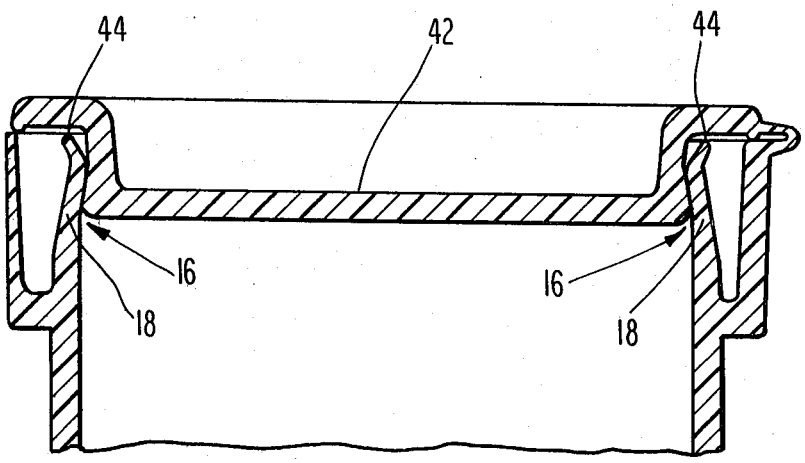
FIGS. 8 and 9 depict alternative embodiments of the present invention, particularly.

In the alternative embodiments of the present invention shown in FIGS. 8 and 9, the closure reinforcement means of the embodiment shown in FIG. 8 comprises a closure cap segment 42 extending across container opening 16 below the upper edge 44 of inner wall 18, so as to provide a brace across opening 16 and thus resist inward radial deformation of the closure at that location.

Figure 9:
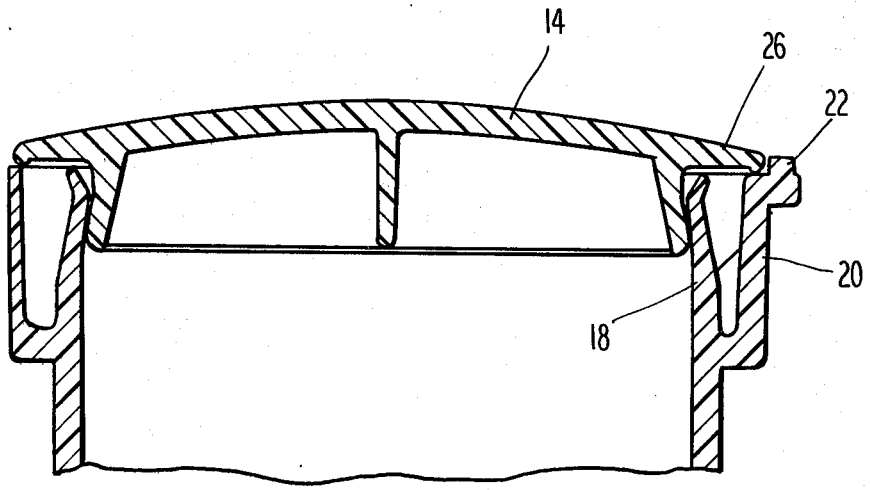

The alternative embodiment of FIG. 9 differs from the preferred embodiment shown in FIGS. 1–7 by the omission of the hingeable connecting member 34, thus providing a two-piece container-closure combination.

In still another alternative embodiment, which is not illustrated, the closure neck (with or without the closure cap attached, as shown in FIGS. 1–8 and FIG. 9, respectively) may be formed as a separate piece from the remainder of the container and attached thereto in a conventional manner by a snap, friction, or threaded fit, and further may be permanently secured thereto by gluing, staking, thermal deformation, or welding.

While this invention has been described with respect to particular embodiments thereof, the appended claims are not intended to be limited thereto. Instead, the appended claims are intended to be construed so as to encompass not only the embodiments of the invention described and illustrated, but also to such other variants of the invention as may be devised by those skilled in the art, without departing from the true spirit and scope thereof.

I claim:

1. A container closure, the closure including a closure neck having an opening surrounded by an inner and an outer wall, and a closure cap including a skirt which matingly engages said inner wall, and a lip which extends to said outer wall, and said outer wall includes at one preselected location an inwardly deformable segment adapted to permit deformation by finger pressure inward, whereupon the underside of the lip of said closure cap is accessible for upward opening finger pressure, the improvement comprising reinforcement means to resist deformation of said closure neck and said closure cap other than at said preselected location.

2. Improved container-closure combination, as recited in claim 1, wherein said reinforcement means comprises ribs disposed on said closure cap and adapted to minimize radial deformation of said closure cap.

3. Improved closure, as recited in claim 1, wherein said reinforcement means comprises ribs radially disposed between said inner and outer walls at a plurality of preselected locations other than that at which is located said inwardly deformable segment.

4. Improved closure, as recited in claim 3, wherein said reinforcement means further includes ribs radially disposed on said closure cap from the center thereof to said dependent skirt.

5. Improved closure, as recited in any one of claims 1, 2, 3, or 4, wherein said outer wall includes an upwardly extending rim adapted to substantially surround the outer edge of said lip, said rim including a discontinuity at said preselected deformable outer wall segment location.

6. Improved closure, as recited in claim 5, wherein, at a location diametrically opposite said deformable segment location, said rim and said lip are connected by a hinge means.

7. Improved closure, as recited in claim 6, wherein said closure cap and said closure neck comprise a single integrally molded piece.

8. Improved closure, as recited in claim 6, wherein said closure neck and a container all comprise a single integrally molded piece.

9. Improved closure, as recited in claim 6, wherein said closure cap, said closure neck and a container all comprise a single integrally molded piece.

10. Improved closure, as recited in claim 1, wherein said reinforcement means comprises a closure cap segment extending across said closure neck opening below the upper edge of said inner wall.

11. Improved closure, as recited in claim 5, wherein said rim includes a removable rim segment which surrounds said outer edge of said lip at said preselected deformable outer wall segment location.

12. A container closure, the closure including a closure neck having an opening surrounded by an inner and an outer wall, and a closure cap including a skirt which matingly engages said inner wall, and a lip which extends to said outer wall, and said outer wall includes at one preselected location an inwardly deformable segment adapted to permit deformation by finger pressure inward, whereupon the underside of the lip of said closure cap is accessible for upward opening finger pressure, the improvement comprising said outer wall includes an upwardly extending rim adapted to substantially surround the outer edge of said lip, said rim including a discontinuity at said preselected deformable outer wall segment location.

* * * * *